United States Patent [19]

Blain

[11] Patent Number: 4,568,256

[45] Date of Patent: Feb. 4, 1986

[54] LUBRICANT SEPARATION IN A SCROLL COMPRESSOR

[75] Inventor: Edward S. Blain, Rockford, Ill.

[73] Assignee: Sundstrand Corporation, Rockford, Ill.

[21] Appl. No.: 612,448

[22] Filed: May 21, 1984

[51] Int. Cl.[4] ..... F04C 18/04; F04C 29/02

[52] U.S. Cl. ..... 418/55; 418/94; 418/DIG. 1; 55/409

[58] Field of Search ..... 418/55, 91, 94, DIG. 1; 55/406, 409

[56] References Cited

U.S. PATENT DOCUMENTS

| | | | |
|---|---|---|---|
| 3,560,119 | 2/1971 | Busch et al. | 418/55 |
| 3,922,114 | 11/1975 | Hamilton et al. | 417/366 |
| 3,924,977 | 12/1975 | McCullough | 418/55 |
| 4,178,143 | 12/1979 | Thelen et al. | 418/55 |
| 4,314,796 | 2/1982 | Terauchi | 418/55 |
| 4,332,535 | 6/1982 | Terauchi et al. | 418/55 |
| 4,340,339 | 7/1982 | Hiraga et al. | 418/55 |
| 4,343,599 | 8/1982 | Kousokabe | 418/55 |
| 4,355,963 | 10/1982 | Tanaka et al. | 418/94 |
| 4,437,820 | 3/1984 | Terauchi et al. | 418/55 |

FOREIGN PATENT DOCUMENTS

| | | | |
|---|---|---|---|
| 2160582 | 6/1973 | Fed. Rep. of Germany | 418/55 |
| 2338808 | 2/1974 | Fed. Rep. of Germany | 418/55 |
| 57-18491 | 1/1982 | Japan | 418/55 |

*Primary Examiner*—John J. Vrablik

*Attorney, Agent, or Firm*—Wood, Dalton, Phillips, Mason & Rowe

[57] ABSTRACT

A positive displacement scroll type apparatus having first and second scrolls with interfitting vanes defining an interface which includes at least one close pocket adapted to move fluid from an inlet to an outlet. The outlet is located in one of the scrolls and is subjected to centrifugal force during operation of the compressor and this in turn causes the separation of lubricant from the compressed fluid by such centrifugal force. A lubricant collector is located at the outlet to prevent the lubricant from entering the remainder of a system with which the compressor may be associated.

17 Claims, 6 Drawing Figures

40
42
14
10
22
44
18
18
26
20
56
24
66
16
56'
12
46
50
52
30
48
28
54
34
32
38
MOTOR
36
30

10
26
58
18
18
60
56'
12

10
64
26
62
58
60
56'

LUBRICANT SEPARATION IN A SCROLL COMPRESSOR

FIELD OF THE INVENTION

This invention relates to positive displacement apparatus. More specifically, it relates to a scroll type compressor and the provision of means for the separation of lubricant from the compressor effluent.

BACKGROUND ART

Over the years, there have been developed a number of proposals for scroll compressors which quite frequently are employed as the compressor element in a refrigerating system. Typically, such compressors include two so-called scroll elements which are generally in the form of facing plates each provided with a helical vane. The vanes on each plate interfit with each other to define one or more closed pockets by points of contact between the vanes on the two plates.

The vanes on one of the plates is made to orbit with respect to the vane on the other so that the pocket or pockets travel from an inlet to an outlet and typically progressively become reduced in size to compress the fluid.

There are two general forms of such compressors. Each, in addition to the foregoing characteristics possesses unique characteristics of its own. For example, one of the two types provides for continuous rotation, in synchronism, of both scroll elements in addition to the relative orbital motion. This approach is exemplified, for example, in Thelen et al. U.S. Pat. No. 4,178,143 issued Dec. 11, 1979.

In the other form of such a compressor, both scroll members are fixed against rotation, although one is allowed to orbit with respect to the other as mentioned previously. This approach is exemplified in, for example, Terauchi et al. U.S. Pat. No. 4,332,535 issued June 1, 1982 and by Kousokabe U.S. Pat. No. 4,343,599 issued Aug. 10, 1982.

Regardless of the approach employed, because of the relative movement between the scroll elements and the fact that near contact between the vanes thereof is required to produce the closed pocket necessary to convey and compress the working fluid, it is highly desirable to lubricate the interface of the two scrolls to minimize wear which, amongst other things, would lead to leakage paths thereby lowering efficiency of the operation of the device. Consequently, it is desirable to introduce a lubricant into the working fluid stream at or about the time it enters the scroll compressor or earlier and an example of such is shown in the previously identified Kousokabe patent. This lubricant serves the desirable function of lubrication to avoid wear and in addition, improves sealing between the scroll members at their points of near contact to increase operational efficiency.

At the same time, it is not particularly desirable to allow the lubricant to exit the compressor to the point where it enters the remainder of the refrigeration system. The lubricant typically will impede heat transfer in heat exchange coils utilized in such systems and, dependent upon the configuration of the plumbing in such a system, may be trapped and therefore unable to return to the compressor to provide the necessary lubrication. This difficulty is likewise recognized by Kousokabe who provides two different schemes for removing the lubricant from the compressor effluent before it can enter the remainder of the system with which the compressor is used. In both cases, Kousokabe utilizes a suction scheme to introduce lubricant into the compressor adjacent its inlet. In one case, the suction system is internal to the compressor housing while in another it is external. The latter is obviously to be avoided since the nature of the system is such it can be easily damaged. Moreover, compactness is sacrificed. In either case, a suction system is not particularly desirable because of the limitation on pressure differentials obtainable which in turn means that the system may be easily clogged and cannot be cleared readily due to such low pressure differential.

As regards removal of lubricant, in one embodiment, Kousokabe utilizes an external cyclone separator. Such a system, while functional, is undesirable in that bulk of the overall compressor is considerably increased and again, there are sensitive components external of the compressor housing which may be easily damaged. In another system, Kousokabe directs output of the compressor against a chamber wall. Presumably, the liquid lubricant agglomerates on such wall and flows to a reservoir by dripping down such wall while the compressed fluid exits through an outlet from the chamber which is so disposed as to prevent entry of lubricant thereinto. The difficulty with this approach is that a fine mist of lubricant may still exist within the chamber and exit the fluid outlet. Such a fluid mist may agglomerate elsewhere in the system and pose the difficulties mentioned previously.

The present invention is directed to overcoming one or more of the above problems.

SUMMARY OF THE INVENTION

It is the principal object of the invention to provide a new and improved lubricant separator in a scroll compressor. More specifically, it is an object of the invention to provide such a separator which is compact and may be contained in the compressor elements themselves, provides lubricant to the compressor inlet under positive pressure so as to resist clogging, and which provides a more positive separation of lubricant from the compressed fluid than is obtainable in prior art devices to avoid prior art problems of impeding of heat transfer in heat exchange coils and the like and/or lubricant starvation.

An exemplary embodiment of the invention achieves the foregoing objects in a positive displacement apparatus of the scroll type including an inlet and an outlet spaced from the inlet. First and second scrolls are disposed between the inlet and the outlet and have interfitting vanes defining an interface and movable with respect to each other. The vanes cooperate to define at least one closed pocket adapted for moving fluid from the inlet to the outlet. Means are provided for moving one of the scrolls in a closed, non-linear path relative to the other scroll so that the pocket moves from the inlet to the outlet. The outlet is located in at least one of the scrolls and is subjected to centrifugal forces during operation of the compressor. A lubricant collection means is provided at the outlet and as a consequence, lubricant in the fluid entering the compressor to lubricate the interface is separated from the fluid by centrifugal force at the outlet and provided to the collection means.

According to another facet of the invention, the lubricant collection means includes a conduit extending from the outlet to the interface at a location spaced from the outlet such that the lubricant separated from the fluid at the outlet is returned to the interface to lubricate the same.

According to still another facet of the invention, there are provided scrolls with an inlet and an outlet as aforesaid and there is further provided a reduced diameter conduit extending from the outlet to the interface opening thereto at an area subjected to more pressure than that at the outlet along with a means associated with the outlet for separating lubricant contained within the fluid emerging from the interface at the outlet and in fluid communication with the conduit. As a consequence, the pressure at the outlet is operative to provide a positive driving force for separated lubricant.

According to still another facet of the invention, a shaft mounts one of the scrolls near its center for rotation and the outlet includes a passage in the shaft. Means are provided for rotating the shaft to thereby rotate the one scroll and cause the pocket to move from the inlet to the outlet while additionally rotating the outlet to provide centrifugal separation of lubricant from the fluid.

In one embodiment of the invention the return conduit for the lubricant extends to a point closely adjacent the inlet. A mechanical filter may be associated with the conduit and the conduit is formed in one of the scrolls.

In another embodiment of the invention, the return conduit opens to tip seals in a vane for lubricating the same.

The invention includes means for inducing a swirl to a fluid and a lubricant at the outlet to effect centrifugal force and a reservoir may be provided for receiving the lubricant separated from the fluid. A cover is provided for the reservoir so that the moving fluid will not entrain lubricant within such reservoir.

The invention is particularly suited for use with scroll type apparatus of the type wherein both scrolls are subjected to rotation. However, the same may also be employed with efficacy in non-rotative scroll constructions where the orbiting movement of the orbiting scroll or swirl imparted to compressed fluid is sufficient to generate centrifugal force sufficient to effect the desired separation of lubricant from such fluid.

Other objects and advantages will become apparent from the following specification taken in connection with the accompanying drawing.

DESCRIPTION OF THE PREFERRED EMBODIMENT

Figures 1, 2, 3:
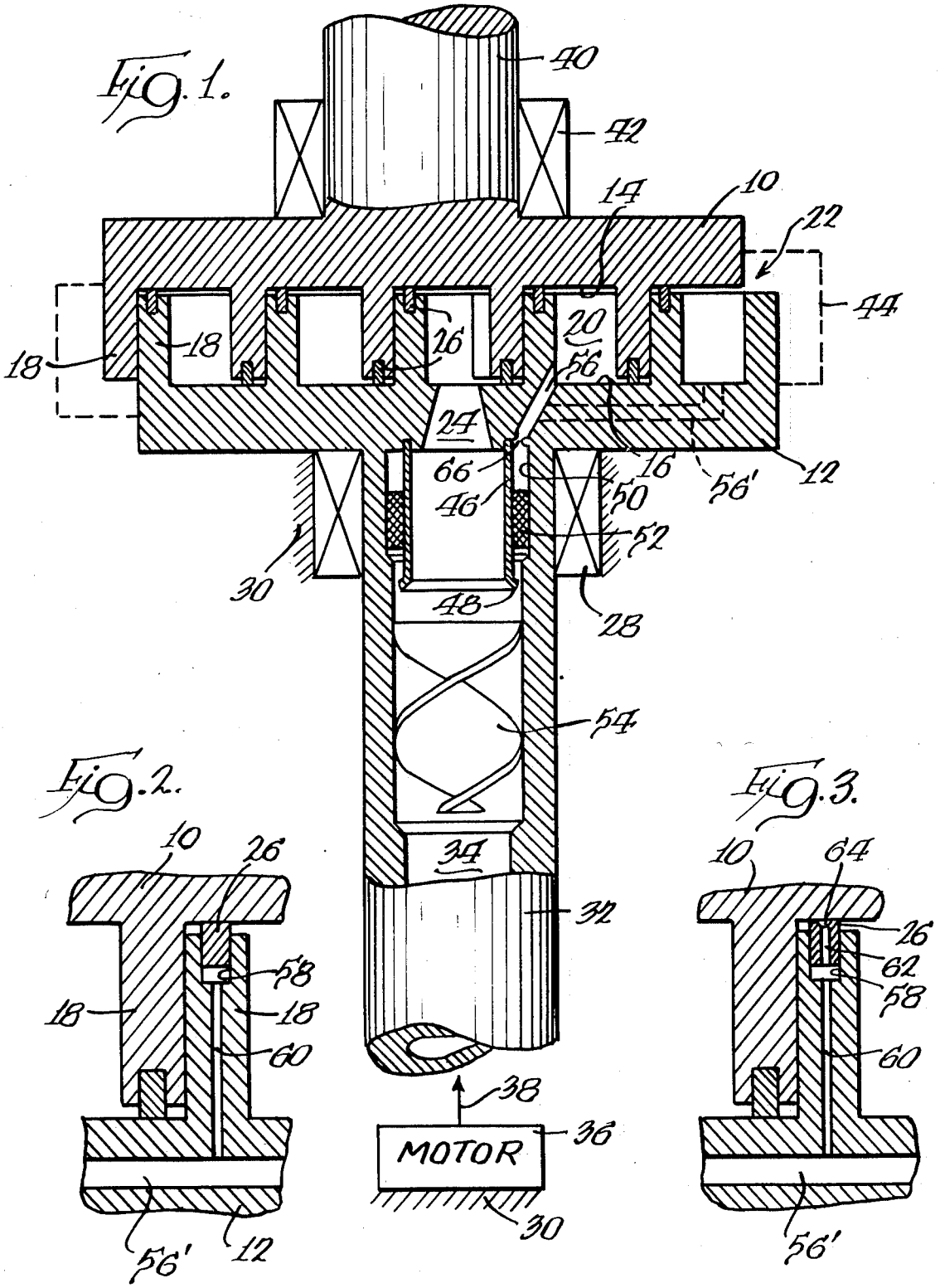
FIG. 1 is a somewhat schematic sectional view of a scroll compressor made according to the invention.
FIGS. 2 and 3 are enlarged fragmentary views of tip seals employed in the invention.

An exemplary embodiment of a positive displacement scroll compressor made according to the invention is illustrated in FIG. 1 and is in the form of that type of scroll compressor wherein both scrolls are rotated. However, it will be appreciated by those skilled in the art that the invention is not so limited and may be employed with efficacy in other types as well. The scroll compressor includes first and second scrolls, 10 and 12 respectively, having facing faces 14 and 16 respectively. The faces 14 and 16 are generally parallel and each mounts a scroll wrap or vane 18. The vanes 18 on the scrolls 10 and 12 interfit to define an interface between the two which, as is well known, includes at least one fluid receiving pocket 20 in which the fluid to be compressed may be received.

At a point 22 adjacent the peripheries of the scrolls 10 and 12 the interface opens to thereby define an inlet. Generally centrally of the scroll 12, there is an opening 24 to the interface which serves as an outlet. The vanes 18 are conventionally formed according to, for example, the teachings of the previously identified patents so that upon rotation of the scrolls 10 and 12, and additionally, the imparting of an orbital movement to the vane 18 or the scroll 10 or 12 with respect to the vane 18 on the other, one or more pockets will continuously advance from the inlet 22 to the outlet 24, all the while decreasing in size to compress the fluid received in each pocket at the inlet 22 before discharging the same through the outlet 24.

To prevent leakage during the compression process, the vanes 18 may be provided with tip seals such as are shown at 26. The remainder of the sealing of each pocket is achieved through essentially near line contact at the ends of each pocket between the sides of the vanes 18 as is well known.

A bearing 28 suitably mounted on a frame shown schematically at 30 journals a shaft 32 for rotation. The shaft 32 is affixed to the scroll 12 at its mid point and in alignment with the outlet 24. The shaft 32 includes a hollow center 34 which serves as a continuation of the outlet 24 and is adapted to be connected into, for example, a refrigerant system for delivering compressed refrigerant thereto.

A motor 36, shown schematically, may likewise be mounted on the frame 30 and includes a driving connection shown schematically at 38 to the shaft 32 for rotating the same.

The scroll 10 is likewise provided with a shaft 40 at its mid point. The shaft 40 undergoes rotation and is mounted in a bearing 42 for the purpose. It will be noticed that the axes of rotation of the shafts 32 and 40 are offset and this is conventional practice in scroll type positive displacement apparatus where both scrolls rotate.

Any conventional linkage as, for example, that disclosed in the previously identified Thelen patent may be used to interconnect the scrolls 10 and 12. Such a linkage is shown schematically at 44 and forms no part of the present invention. It is simply sufficient to note that the linkage 44 couples the scrolls 10 and 12 so that they rotate synchronously when the shaft 32 is being driven by the motor 36.

According to the invention, the outlet 24 in the scroll 12 is surrounded by a sleeve 46 which extends into the hollow 34 of the shaft 32 in spaced relation to the sides thereof to terminate in an outwardly directed lip 48. The interior of the shaft 32 is slightly stepped as at 50 in the vicinity of the sleeve 46. The step 50 and its separation from the sleeve 46 define an annular reservoir for lubricant. Lubricant may enter the reservoir via the small space between the lip 48 and the interior of the hollow 34 in the shaft 32. Thus, the sleeve 46 acts as a cover for the reservoir preventing lubricant in the reservoir from being entrained by fluid under pressure exiting the interface between the scrolls 10 and 12 via the outlet 24.

If desired, a mechanical filter 52 of any suitable form may be inserted between the sleeve 46 and located in the step 50 of the shaft 32 to remove particulates from lubricant entering the reservoir.

In operation of the apparatus, rotation of the shaft 32, and thus the scroll 12 will impart rotation to the compressed fluid entering the shaft 32 from the outlet 24. The fluid will be in a gaseous phase but will contain entrained liquid such as the lubricant added at the inlet 22. As a consequence of the rotation imparted to the exiting compressed gas, centrifugal force will cause the denser drops of entrained liquid to move radially outwardly against the inside surface of the shaft 32. From there, the liquid may be made to flow to the reservoir 50 by any of a variety of means.

For example, just below the end of the sleeve 46, there may be provided, within the shaft, a swirl inducing means 54. As illustrated, the swirl inducing means 54 is in the form of a twisted metal tape or the like.

The swirl inducing means 54 may be alternatively used to promote gas flow in the direction of gas discharge from the shaft 32. Where it is desired to both promote gas flow in the direction of discharge from the shaft 32 as well as to cause lubricant to be directed to the reservoir 50, the interior of the shaft 32 may be provided with a helical spring pitched to achieve the latter purpose and a twisted tape such as shown in the drawing may be inserted within the spring and pitched to promote gas discharge.

It will also be noted that the swirl inducer 54 promotes centrifugal separation of lubricant by imparting an additional rotative flow to the exiting gas.

In a preferred embodiment of the invention, the reservoir 50 may be emptied via a conduit 56 extending thereto. As illustrated, the conduit 56 is essentially interconnected between the outlet 24 via the reservoir 50 and the interface between the scrolls 10 and 12. It will be observed that the connection to the latter is radially outwardly of the connection to the former. Thus, during rotation of the shaft 32, centrifugal force will tend to urge lubricant in the reservoir 50 back to the interface for lubricating purposes via the conduit 56. In some cases, it may be desirable that the conduit 56 open to the interface substantially at the inlet as shown in dotted lines at 56'.

Alternately, or in addition to the foregoing, the lubricant may be directed to the tip seals 26. One means by which such may be obtained is illustrated in FIG. 2. As can be seen, the end of the vane 18 includes an axially opening groove 58 in which a tip seal 26 is received. At various locations, axially extending conduits 60 may interconnect the conduit 56 or 56' to the groove 58. As a consequence of this construction, lubricant will be directed to the groove 58 to lubricate the tip seal 26 as it undergoes minute movement within the groove 58. Additionally, a certain amount of the lubricant will pass through the interface of the tip seal 26 in the groove 58 to flow along the tip seal 26 to the interface between the scrolls 10 and 12 which the tip seal 26 is sealing to lubricate such sealing contact.

Other similar means for achieving the same purpose are shown in FIG. 3. Where like components are utilized, they are given like reference numerals. In the FIG. 3 embodiment, the tip seal 26 may be provided at various locations along its length with axially opening conduits 62 which open to a groove 64 along the length of the sealing surface of the tip seal 26. Again, lubricant will be provided via the conduit 60 to the groove 58 to lubricate the interface of the tip seal 26 and such groove 58. Additionally, lubricant will flow through the conduit 62 to the groove 64 to provide direct flow of lubricant to the seal point of the tip seal 26 with the facing scroll.

Those skilled in the art will also appreciate that the pressure at the interface between the scrolls 10 and 12 increases as one moves radially inwardly from the inlet 22 to the outlet 24. Thus, it will be further appreciated that the conduit 56 opens to the interface at an area of relative lower pressure than that found at the outlet. Consequently, the pressure of the gas 24 at the outlet may also be used in addition to centrifugal force to cause the flow of lubricant back to the interface from the reservoir 50. To prevent too much back flow, the conduit 56 is restricted as, for example, by a narrowing shown at 66. Alternatively, the restriction can be made simply by suitably selecting the cross sectional area or shape of the conduit 56.

Figure 4:
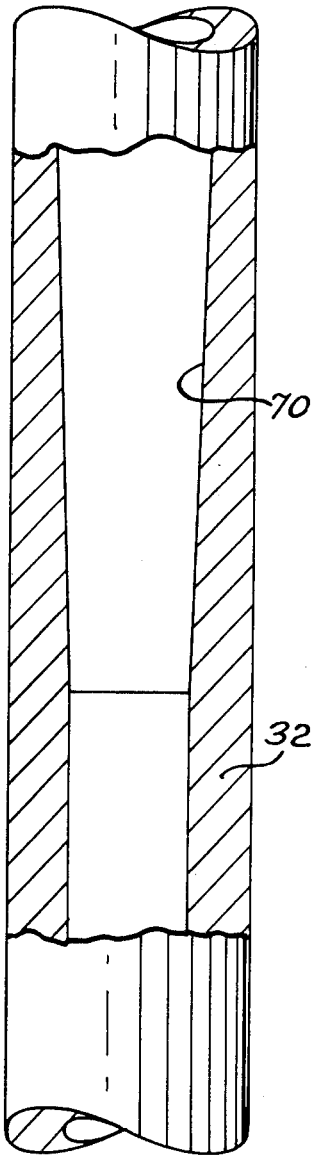
FIGS. 4–6 illustrate different embodiments of a swirl inducing means that may be utilized in the invention
Figure 5:
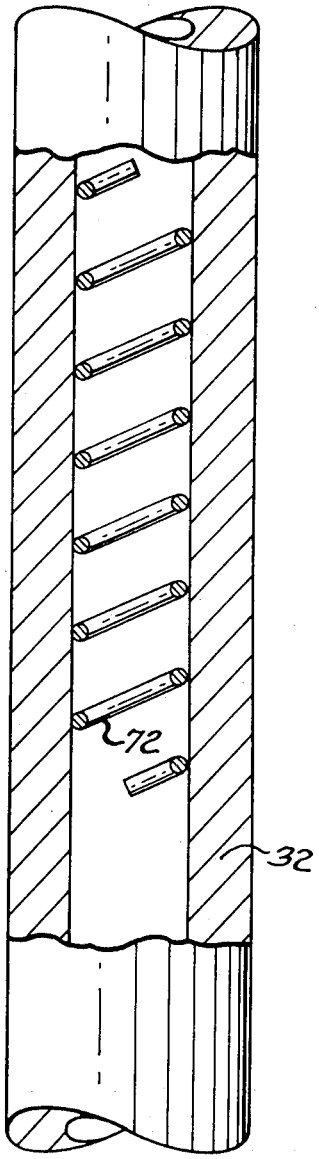
Figure 6:
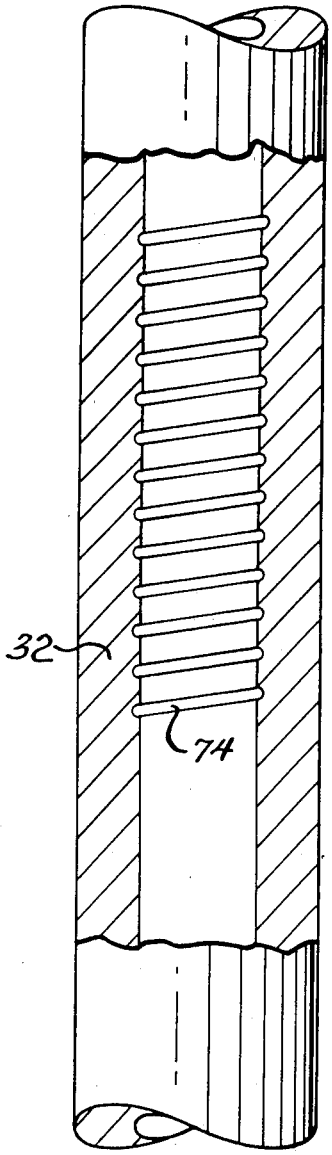

Turning now to FIGS. 4–6 inclusive, the same illustrate alternate forms of swirl inducing means that may be utilized in lieu of the swirl inducing means 54. In FIG. 4, the swirl inducing means is provided by increasing the diameter of the interior of the shaft 32 from bottom to top as illustrated at 70.

FIG. 5 illustrates the use of a helical spring 72 on the interior of the shaft 32 for the same purpose. FIG. 6 shows the use of helical grooves 74 machined in the interior of the shaft 32. In any event, the twist of such swirl inducing means are made such that with the direction of rotation of the shaft 32 in mind, any lubricant impinging on the interior of the shaft 32 is directed axially upwardly toward the reservoir 50. In some cases, as mentioned above, the relatively high pressure of the compressed fluid at the outlet may be used to move the lubricant.

From the foregoing, it will be appreciated that a scroll compressor made according to the invention provides for lubricant separation within the operating compressor elements themselves to provide an extremely compact assembly. This feature also eliminates any need for separators in plumbing external to a compressor housing which add bulk and could be damaged. It will also be appreciated that the system provides for positive pressurization of the return lubricant by centrifugal force or the pressure of the gas at the outlet, or both. Thus, the difficulties of various prior art constructions are all avoided.

I claim:

1. A scroll compressor comprising:

first and second scrolls having interfitting vanes defining a pumping interface including a movable fluid containing pocket;

means for moving one of said scrolls in a closed, non-linear path relative to the other to cause said pocket to move along said interface;

a radially inner outlet partially in at least one of said scrolls and opening to said interface;

a radially outer inlet opening to said interface;

an open conduit within said one scroll extending from said outlet to said interface remote from said outlet; and means associated with said outlet for inducing rotary motion in a fluid therein to cause centrifugal separation of lubricant in the fluid from the fluid in the vicinity of said conduit.

2. The scroll compressor of claim 1 wherein said inducing means comprises means for rotating said one scroll and said outlet.

3. The scroll compressor claim 1 wherein said inducing means comprises a swirl inducer in said outlet.

4. A positive displacement compressor comprising:
an inlet;
an outlet spaced from said inlet;
first and second scrolls between said inlet and said outlet and having interfitting vanes defining an interface and movable with respect to each other, said vanes cooperating to define at least one closed pocket adapted for moving fluid from said inlet to said outlet;
means for rotating both of said scrolls and for moving one of said scrolls in a closed, non-linear path relative to the other scroll so that said pocket moves from said inlet to said outlet;
a portion of said outlet being located in at least one of said scrolls and being subjected to centrifugal force during operation of said moving means and being located radially inwardly of said inlet; and
an open conduit means extending from said outlet to said interface at location radially outwardly of said outlet;
whereby lubricant in the fluid entering the compressor to lubricate said interface may be separated from the fluid by centrifugal force in said outlet and returned to said interface.

5. The compressor of claim 4 wherein said conduit means extends to said interface at a point closely adjacent said inlet.

6. The compressor of claim 4 wherein there is a mechanical filter associated with said conduit means.

7. The compressor of claim 4 wherein said conduit means is formed in one of said scrolls.

8. The compressor of claim 4 wherein at least one of said vanes mounts tip seal means and said conduit means extends from said outlet to said tip seal means.

9. The compressor of claim 4 wherein said outlet includes means for inducing swirl to fluid and lubricant therein.

10. the compressor claim 4 wherein said outlet includes a reservoir for receiving said lubricant separated from the fluid and said conduit means opens to said reservoir; and further including a cover for said reservoir.

11. A scroll compressor comprising:
first and second scrolls having interfitting vanes defining a pumping interface including a movable fluid containing pocket;
a shaft mounting one of said scrolls near its center for rotation;
a fluid inlet to said interface near the periphery of said scrolls;
a fluid outlet from said interface in said one scroll and including a passage in said shaft;
an open conduit within said one scroll extending from said outlet to said interface; and
means for rotating said shaft to thereby rotate said one scroll and cause said pocket to move from said inlet to said outlet and for rotating said outlet to centrifugally separate lubricant in a fluid at said outlet for delivery to said conduit.

12. The scroll compressor of claim 11 wherein said conduit opens to said interface radially outwardly of said outlet.

13. The scroll compressor of claim 11 wherein at least one of said vanes on one of said scrolls includes an axially opening groove receiving a tip seal sealingly engaging the other of said scrolls and said conduit extends to said groove.

14. The scroll compressor claim 11 wherein said passage includes a spiral configuration.

15. The scroll compressor of claim 14 wherein said spiral configuration is operative to move lubricant in said passage toward said conduit.

16. The scroll compressor of claim 14 wherein said spiral configuration is operative to induce a rotary motion to fluid exiting said interface.

17. A scroll compressor comprising:
first and second scrolls having interfitting vanes defining a pumping interface including a movable fluid containing pocket;
means including a hollow shaft for moving one of said scrolls in a closed, non-linear path relative to the other to cause said pocket to move along said interface;
at least one of said scrolls having an outlet opening to said interface and to the interior of said hollow shaft;
an inlet opening to said interface;
said scrolls, upon relative movement by said moving means, providing increasing fluid pressure in said pocket from said inlet to said outlet;
an open conduit including a restriction and placed in fluid communication with said outlet by said hollow shaft and opening thereto at an area subjected to less fluid pressure than at said outlet, said conduit and said restriction being wholly within one of said scrolls; and
means associated with said outlet for separating lubricant contained within fluid emerging from said interface at said outlet and in fluid communication with said conduit.

* * * * *